United States Patent [19]

Likozar

[11] Patent Number: 4,621,468

[45] Date of Patent: Nov. 11, 1986

[54] CONCRETE METAL-BACKED ACCESS FLOOR PANEL

[75] Inventor: Martin E. Likozar, Rocky River, Ohio

[73] Assignee: Donn Incorporated, Westlake, Ohio

[21] Appl. No.: 629,980

[22] Filed: Jul. 11, 1984

[51] Int. Cl.[4] ..... E04B 5/58

[52] U.S. Cl. ..... 52/126.6; 52/792; 52/263

[58] Field of Search ..... 52/21, 126.6, 263, 335, 52/336, 509, 512, 602, 811, 822

[56] References Cited

U.S. PATENT DOCUMENTS

| | | | |
|---|---|---|---|
| 3,696,578 | 10/1972 | Swensen | 52/792 |
| 3,780,480 | 12/1973 | Cvijanovic | 52/263 |
| 3,845,593 | 11/1974 | Zen | 52/602 |
| 4,016,697 | 4/1977 | Ericson | 52/612 |
| 4,067,156 | 1/1978 | Downing | 52/126.6 |
| 4,411,121 | 10/1983 | Blacklin | 52/792 |
| 4,426,824 | 1/1984 | Swensen | 52/794 |

FOREIGN PATENT DOCUMENTS

| | | | |
|---|---|---|---|
| 2307815 | 9/1974 | Fed. Rep. of Germany | 52/126.6 |
| 2545854 | 10/1976 | Fed. Rep. of Germany | 52/126.6 |
| 1523900 | 3/1968 | France | 52/126.6 |

OTHER PUBLICATIONS

Architectural Review, May 1984.

*Primary Examiner*—Henry E. Raduazo
*Assistant Examiner*—Dan W. Pedersen
*Attorney, Agent, or Firm*—Pearne, Gordon, Sessions, McCoy, Granger & Tilberry

[57] ABSTRACT

A composite access floor panel is disclosed which provides a sheet metal pan filled with a lightweight concrete material. The bottom wall of the pan is contoured so that the thickness of the concrete varies from one location to another. The illustrated panel provides a border of uniform maximum thickness and a central portion of reduced intermediate thickness. In addition, the panel produces concrete oval corner portions and circular side portions spaced in from the centers of the panel sides, both of which provide a uniform minimum thickness. The contours of the panel create a panel in which a substantially uniform amount of deflection results when the panel is supported at its corners and a given load is applied anywhere along the load surface thereof spaced from the panel corners. Shear ties are provided along the interface between the pan and the concrete to cause the pan and concrete to coact in supporting loads applied to such load surface.

13 Claims, 12 Drawing Figures

CONCRETE METAL-BACKED ACCESS FLOOR PANEL

BACKGROUND OF THE INVENTION

This invention relates generally to elevated or access floor structures in which panels are supported at their corners on pedestals, and more particularly to a novel and improved access floor panel comprising a contoured metal pan filled with lightweight concrete.

PRIOR ART

Many types of access floor panels are known. Often such panels are formed entirely of sheet metal. An example of such a panel is illustrated in U.S. Pat. No. 4,426,824. It is also known to construct such panels of reinforced concrete, as exemplified by U.S. Pat. No. 4,067,156, and to produce panels consisting of relatively flat pans filled with a castable material in which the depth of the composite panel is relatively uniform.

Because of the strength of metal, all metal panels can be relatively lightweight. However, metal is relatively expensive per pound, and such panels tend to require surface coverings to eliminate objectionable metallic noise when loads engage the panels. Further, such panels often tend to provide non-uniform deflections as rolling loads move across the panel tending to cause the loads to bounce or jump.

Concrete panels, on the other hand, although they are formed of a material which is much less expensive per pound, are relatively heavy. Therefore, concrete panels are more expensive to ship and are more difficult to handle and install. They do, however, avoid the metallic sound problem which exists in all-metal panels.

SUMMARY OF THE INVENTION

The present invention provides a novel and improved composite metal and concrete panel structured to minimize weight and material costs while providing good load supporting characteristics. Such panels provide a contoured sheet metal pan filled with a lightweight concrete material. The pan is shaped so that the thickness of the panel varies materially from one location to another to match the panel strength and stiffness with the imposed stresses and deflections of the panel when loads are applied at various locations along the panel surface.

Such contouring drastically reduces the weight of the panel compared to most prior art concrete panels while minimizing the amount of expensive metal required to produce the panel. Consequently, the weight of the panel is maintained within acceptable values, and the cost of the material required to produce the panel is drastically reduced when compared to all-metal panels. Further, since the concrete provides the load-bearing surfaces, it is not necessary to provide a panel covering for sound-deadening purposes.

In order to provide the required strength and stiffness while minimizing panel weight, the metal pan contour is selected so that a given concentrated load applied anywhere along the surface of the panel spaced from the corners will produce a substantially uniform amount of panel deflection. For example, when the illustrated panel is supported at its corners, a substantially uniform panel deflection of 0.030 inch will result under the concentrated rated load when it is applied anywhere along the panel mid-span centerlines. Deflections elsewhere on the panel will be less than 0.030 inch. Further, such panel provides a safety factor of at least 2. Still further, the pan design prevents catastrophic failure in the unlikely event that the concrete degrades due to severe abuse.

Because the panel deflects uniformly, rolling loads moving across the panel do not tend to bounce or jump. Further, the metal pan is shaped to provide metal rails which border the load surface so that the edges of the concrete do not tend to chip or erode when rolling loads are repeatedly moved over the panel edges. Such rails also add beam strength along the edges of the panels.

In the illustrated embodiments, the panel borders are provided with a uniform maximum depth. Such borders are widest along the central portion of each side of the panel, since loads applied along the center of the edge of the panel produce a maximum stressing of the panel. The central portion of the panel is provided with a substantially uniform intermediate thickness less than the maximum thickness along the borders of the panel. Such intermediate thickness produces the required stiffness to closely match the stresses imposed on the panel along such central portion.

Adjacent to each corner, the panel provides an oval portion of uniform minimum thickness. Also, a circular portion of such uniform minimum thickness is provided along each panel side, but is spaced from the adjacent side a substantial distance. These ovals and circular portions substantially match the panel stiffness with the panel stresses and deflections along such portions.

Finally, the illustrated panels provide a novel and improved shear tie structure which interconnects the metal panel and the concrete so that they cooperate and work in unison to properly support the applied loads. Such shear ties are integrally formed from the pan material and provides an omnidirectional connection structure between the concrete and the metal pan.

These and other aspects of the present invention are illustrated in the accompanying drawings, and are more fully described in the following specification.

BRIEF DESCRIPTION OF THE DRAWINGS

.

DETAILED DESCRIPTION OF THE DRAWINGS

Figure 1:
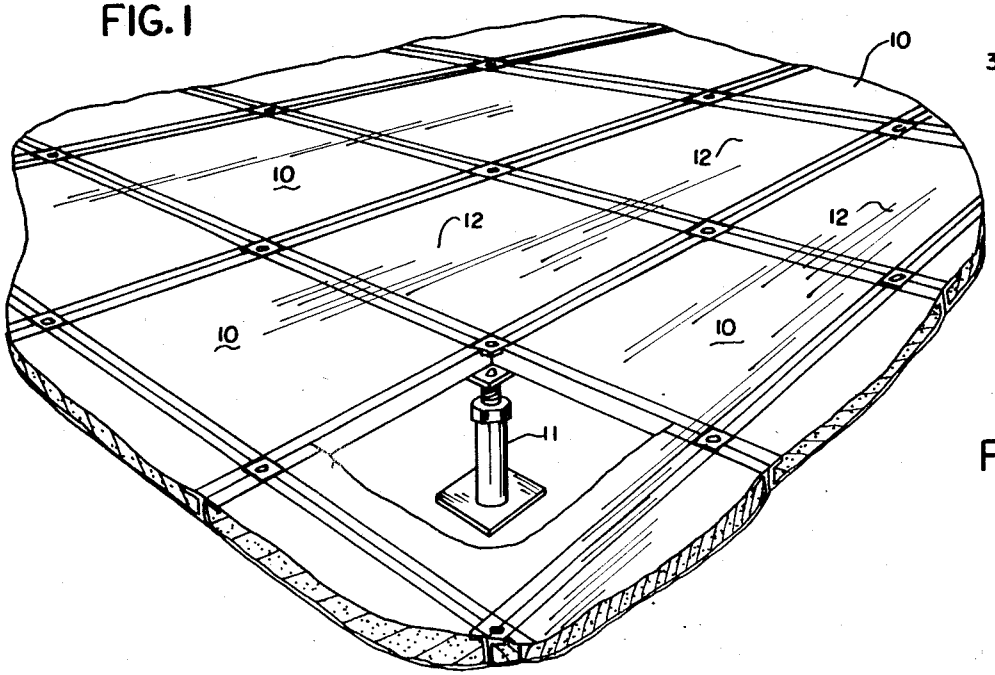
FIG. 1 is a perspective view of a portion of a floor incorporating panels in accordance with this invention.

FIG. 1 illustrates a portion of an access floor incorporating panels 10 in accordance with the present invention. Such panels, in the illustrated embodiments, are square; however, rectangular or other panel shapes may incorporate the present invention.

In an assembled floor, four panels 10 provide corners which are immediately adjacent to each other and each of the adjacent four corners is supported on an adjustable pedestal 11 in a manner described in greater detail below.

Each of the panels provides a load surface 12 which cooperates with the load surface of the remaining panels to provide the floor surface. When access is required beneath the floor, individual panels may be removed and subsequently replaced.

Figure 2:
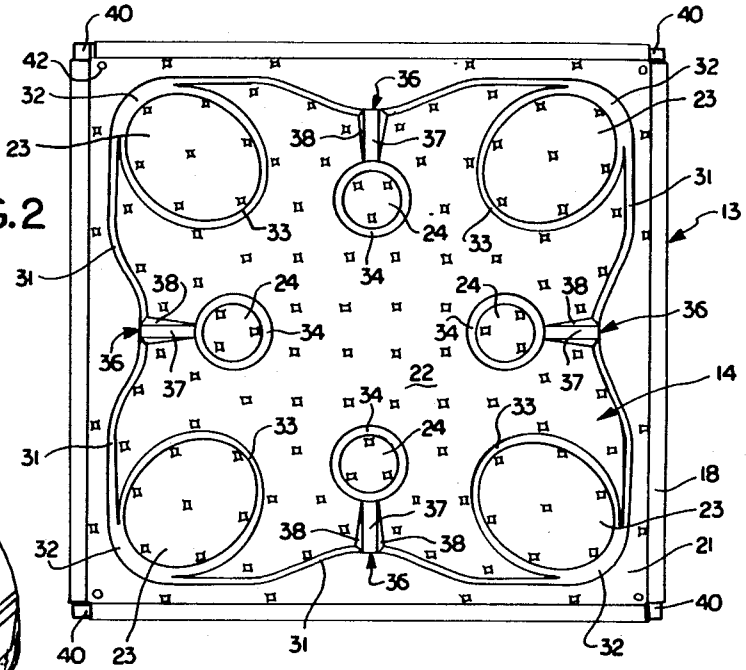
FIG. 2 is a plan view of the metal pan of a first embodiment of a panel prior to filling with concrete, and illustrating the general contours of the pan.

FIGS. 2 through 8 illustrate a first embodiment. FIG. 2 is a plan view of a sheet metal pan 13 which constitutes one of the principal parts of a panel in accordance with this invention. In the finished panel, the pan is filled with a lightweight concrete material 15; however, in FIG. 2, the concrete material is not illustrated so as to better illustrate the contours of the pan.

Figure 5:
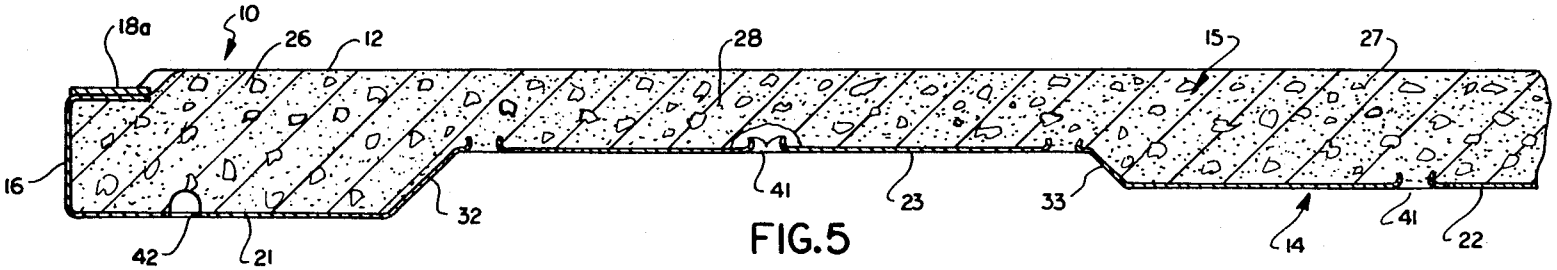
FIG. 5 is a fragmentary section, taken along line 5—5 of FIG. 4.
Figure 6:
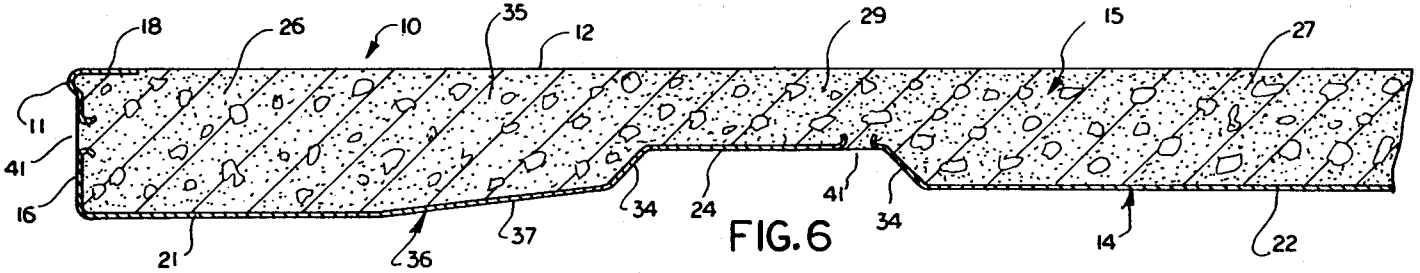
FIG. 6 is a fragmentary section, taken along line 6—6 of FIG. 4.
Figure 7:
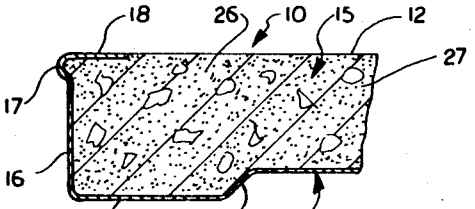
FIG. 7 is a fragmentary section, taken along line 7—7 of FIG. 4.

The pan 13 is die-formed from sheet metal to provide a contoured bottom wall 14 with upstanding side walls 16 (illustrated in FIGS. 5 through 7). The side walls 16 along the portions thereof spaced from the corners extend up to a lateral rib 17 and at the upper edge of the rib the pan material extends inwardly to provide a horizontal, inwardly extending flange 18 which extends completely around the four sides of the panel 13.

The bottom wall 14 is contoured to provide zones of different panel depth. In this illustrated embodiment there are three principal depth zones. The first principal depth zone and the deepest part of the panel is provided around the periphery of the panel by a planar border wall portion 21 extending inwardly from the side walls 16. The second principal depth zones is of intermediate depth and is provided by a planar central wall portion 22. Such central wall portion is again planar, and in the finished panel creates a central panel portion of uniform intermediate thickness.

There are eight separated third principal zones of a uniform minimum thickness also provided. Four such zones of minimum panel thickness are provided by four separate oval-shaped wall portions 23, which are symmetrically positioned with respect to the diagonal of the panel substantially adjacent to the four corners of the panel. Four additional zones of minimum thickness are provided by circular wall portions 24 located along centerlines of the panel so that one circular wall portion 24 is positioned inwardly from the mid-point of each side of the panel.

In this illustrated embodiment, all of the oval-shaped wall portions 23 and circular wall portions 24 are contained within a single plane above the plane of the central wall portion 22, and the central wall portion 22 is contained within a single plane spaced above the plane of the border wall portion 21. Consequently, when the pan 13 is filled with concrete 15, the completed panel provides a concrete border 26 having a uniform maximum depth above the border wall portion 21 of the pan, a central concrete portion 27 of uniform intermediate depth above the central wall portion 22, four oval-shaped concrete portions 28 above the oval wall portions 23 of minimum concrete thickness, and four spaced circular concrete portions 29 having the same thickness as the oval concrete portions 28 located above the circular wall portions 24.

The pan bottom wall 14 is also formed with inclined walls providing the transitions between the various planar wall portions. First inclined walls 31 extend between the border wall portion 21 and the central wall portion 22, where such wall portions are adjacent to each other. Second inclined walls 32 extend between the border wall portion 21 and the oval wall portion 23, where such wall portions are adjacent to each other. Third inclined walls 33 extend between the central wall portion 22 and the oval wall portions 23, where such wall portions are adjacent to each other. Fourth inclined walls 34 extend between the central wall portion 22 and the circular wall portions 24, where such wall portions are adjacent to each other.

In this illustrated embodiment, each of the first through fourth inclined walls is angled with respect to the plane of the adjacent wall portions by an angle of about 45 degrees.

The bottom wall contour is also shaped to provide four ramp sections 36 which extend up from the plane of the border wall portions 21 to the bottom of the fourth inclined walls 34 of the associated circular wall portion 24. The concrete 35 above each of the ramps 36 decreases in thickness gradually from the concrete border 26 to a junction with the portion of the concrete above the inclined wall 34, where it decreases in thickness more abruptly. The ramps provide an inclined wall 37 and inclined tapered side walls 38, which join the inclined wall portion 37 and the central wall portion 22.

In order to cause the concrete of the panel to properly coact with the metal pan in resisting loads, a plurality of shear ties 41 are integrally formed in the metal of the pan at various locations to tie the concrete and metal pan together at intervals along the interface therebetween. The particular structure of such shear ties and their location are described in detail below.

Figure 9:
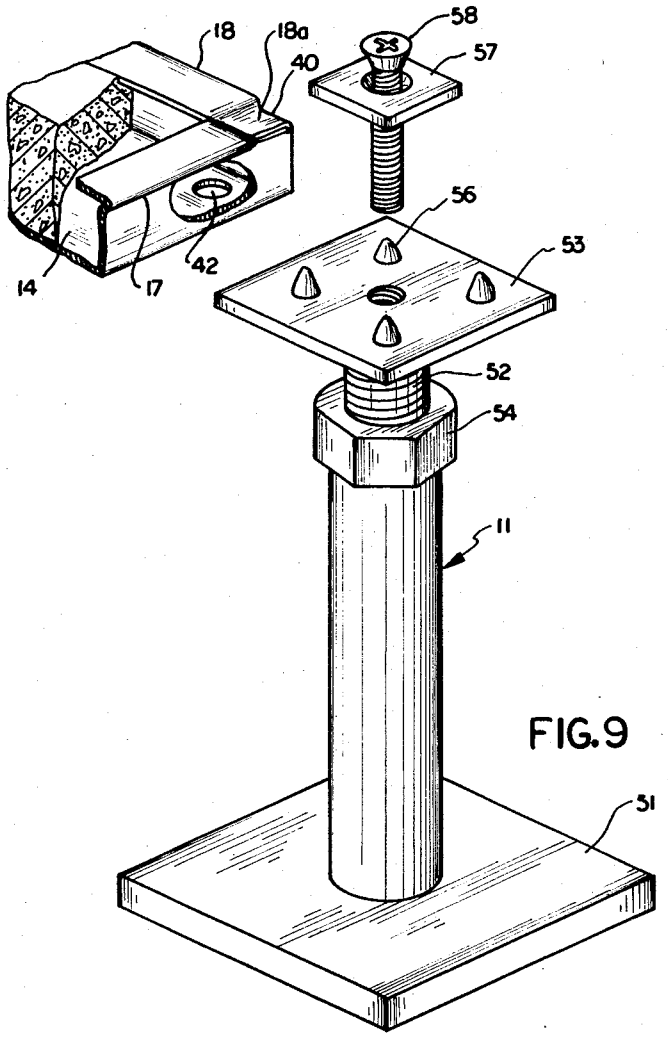
FIG. 9 is an exploded, perspective view of the corner support pedestal structure for the panels.
Figure 4:
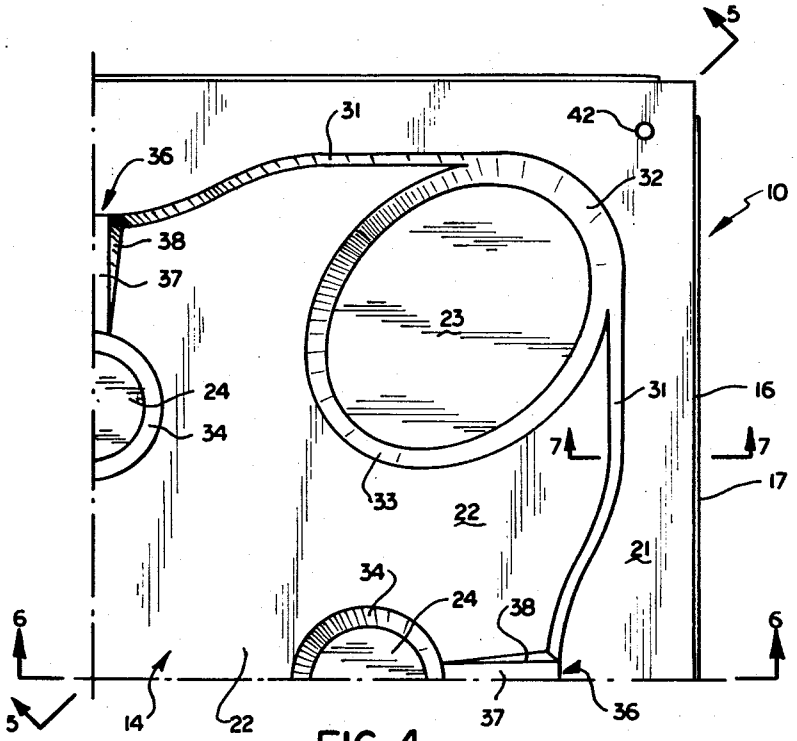
FIG. 4 is a fragmentary view of the bottom of a panel, broken away along the centerlines thereof, and illustrating the contours thereof; in such view, the shear ties have been eliminated for purposes of illustration clarity.

Adjacent to each corner of the panel, as best illustrated in FIGS. 5 and 9, the side wall 16 extends directly up to the flange 18 without providing a rib 17 and the adjacent portions of the flange 18a are recessed below the plane of the remaining portions of the flange 18 a small distance to provide a shallow recess 40 to accommodate a tie plate secured to the associated pedestal 11, as discussed in detail below. Therefore, a small square recess 40 is provided at each corner of each panel. In the recess 40, the metal is formed to overlap and the overlapping portions are spot-welded. This structure provides an effective tie between the side walls of the panel. In addition, the bottom wall 14 of each panel is formed with a circular opening 42 adjacent each corner, into which an upstanding projection provided by the associated pedestal projects to lock the pedestals and panels against lateral movement with respect to each other once the floor is assembled.

After the pan 13 is formed, as described above, the pan is filled with concrete 15 so that the upper surface of the concrete is flush with the upper surfaces of the flanges 18 and cooperates with the flanges to provide the load surface 12 of the panel. The flanges 18 cooperate with the upper surface of the concrete and provide a metallic border completely around the panel which resists chipping or erosion of the concrete along the edges of the panel when the panel is crossed repeatedly by rolling loads.

Figure 3:
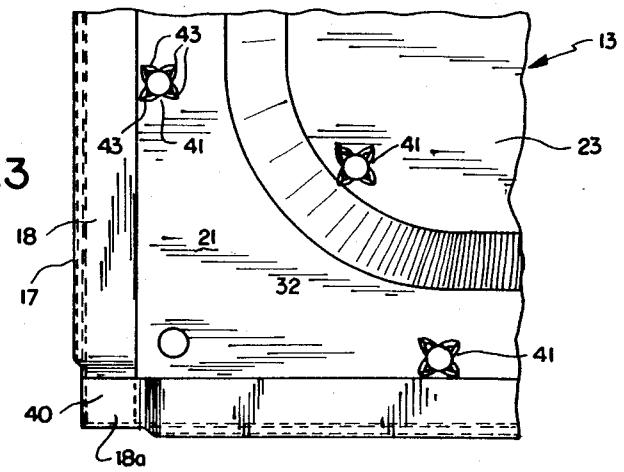
FIG. 3 is an enlarged, fragmentary view, taken adjacent to one corner of the panel, and illustrating the structural details thereof.
Figure 8:
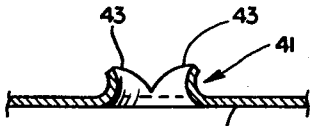
FIG. 8 is an enlarged, framentary section through one of the shear ties illustrating the structural details thereof.

The shear ties 41 have a structure best illustrated in FIGS. 3 and 8. Such shear ties are lanced from the pan material and provide four inclined and tapered projections 43 which extend up and diverge outwardly into the concrete of the finished panel. The shear ties provide an omnidirectional interconnection between the concrete and the panel surface so that the metal of the pan, which is strong in tension, coacts with the concrete, which is strong primarily in compression, to efficiently support loads applied to the load surface 12. Such shear ties 41 are strategically located along the interface between the concrete and the panel so as to efficiently provide such coaction.

For example, in the first illustrated embodiment, there are four shear ties located along each side of the panel within the border wall portion 21. Six shear ties are symmetrically positioned around each of the oval wall portions 23 adjacent to the edges thereof, and one shear tie is positioned in the center of each oval wall portion. The circular wall portions 24 are provided with three shear ties symmetrically positioned around the edges thereof. Additionally, the central wall portion 22 is provided with sixty-four shear ties 41, which tend to be located in a rectangular pattern substantially two inches on centers along the middle parts of the central wall portion and are concentrated somewhat along the first inclined wall 31 adjacent thereto.

Additional shear ties 41 may be provided in the side wall 16. One is located along the center of each side wall and the other two are located relatively close to the corners of the side walls. The particular arrangement of the shear ties has been found in tests to be efficient in ensuring coaction between the concrete and the metal pan. However, other shear tie arrangements or other types of interconnection may be provided if desired. For example, within the broader aspects of this invention, adhesive may be utilized along the interface between the concrete and the metal pan at selected locations or, for that matter, along the entire interface if desired.

Preferably, the pan is filled with a light-weight, high-strength concrete material 15 so as to provide good panel strength characteristics with relatively low total panel weight. One preferred concrete composition includes a blend of expanded shale and vermiculite aggregates. In addition to these lightweight components, the composition includes a high grade concrete admixture and high early strength cement to obtain a material which approaches half the weight of normal concrete while maintaining many of concrete's impressive structural properties. Further, the concrete mixture should contain an air content selected to reduce weight per cubic volume while meeting the required strength characteristics of the final product. As used herein, the term "concrete material" is intended to mean aggregates bonded by a Portland-type cement or equivalent thereof which can be cast in the pan and cured.

Preferably, the pan is drawn from a single sheet of zinc-coated high strength steel. In a typical panel having a nominal dimension of 24"×24" the pan material has a thickness of about 0.030. In this particular panel illustrated, the depth of the concrete along the concrete border 26 is about $1\frac{5}{8}$ inches. The central wall portion 22 is displaced above the plane of the border wall portion 21 about $\frac{1}{4}$ inch and the oval wall portions 23 and circular wall portions are displaced above the border wall portions about $\frac{5}{8}$ inch. Such panel provides a total weight of about 43 pounds, with about 15% of the total weight resulting from the metal content and about 85% of the total weight resulting from the concrete content.

Such panel is significantly heavier than a corresponding all-metal panel, but because of the substantial difference in the cost per unit weight of concrete when compared to steel, the total material cost of the panel is substantially lower than the material cost of such a comparable all-steel panel. Further, the deflection of the composite panel unit its rated load is substantially less than the deflections encountered under rated loading of an all-metal panel.

FIG. 9 illustrates a preferred pedestal structure, and the structure for interconnecting the pedestal 11 and the adjacent panels. The pedestal 11 provides a base 51 which rests on the subfloor and an upstanding tube. A screw 52 is provided with a support plate 53 at its upper end and extends through an adjusting nut 54 supported on the upper end of the tube so that the height of the support plate can be adjusted to the desired level.

The support plate is provided with four symmetrically arranged projections 56, which are located and proportioned so that one extends into the opening 42 formed in the bottom wall 14 of each adjacent panel pan. Therefore, each of the four panels, supported by a given support plate, is properly located with respect to the other and with respect to the pedestal 11. After the panels are properly positioned over the projections 56, a hold-down plate 57 is installed by threading a screw 58 down into the pedestal 11 to clamp against the upper side of the four panels at the corner thereof. As mentioned previously, the flanges 18 are recessed at 40 so that the top of the hold-down plate 56 and the screw 58 are flush with the upper load surface 12 of the panels.

In the illustrated embodiments, the hold-down plate 57 is square and is sized to fit into each of the four recessed portions at 40 of four adjacent panels. Because the rib 17 terminates at the beginning of the recess, sufficient space is provided between the corners of each of the four panels to receive the screw 58, even though the ribs 17 of adjacent panels are in substantial abutting contact along the remaining edge portions of the panels.

In the event that it becomes necessary to remove any particular panel from its installed position within a floor structure, the screws at the various corners of the panel which must be removed are removed to release the associated hold-down plates 57. The panel can then be easily removed and subsequently reinstalled.

Figure 10:
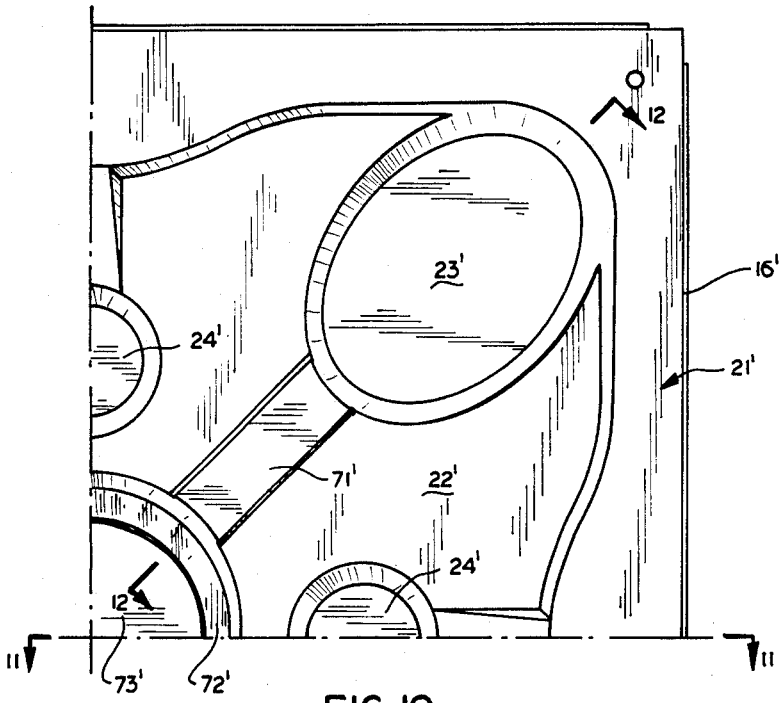
FIG. 10 is a bottom view of a portion of a second embodiment panel in accordance with this invention in which the shape of the panel bottom is modified to provide the unfilled pan with improved stability. Here again, the shear ties are not illustrated to provide clarity to the illustration of the panel.
Figure 11:
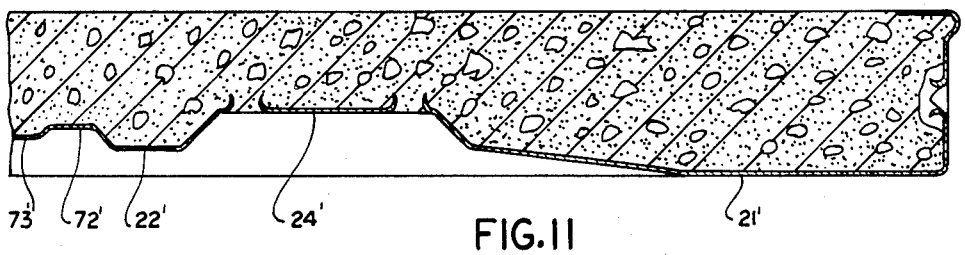
FIG. 11 is a fragmentary section taken along line 11—11 of FIG. 10.
Figure 12:
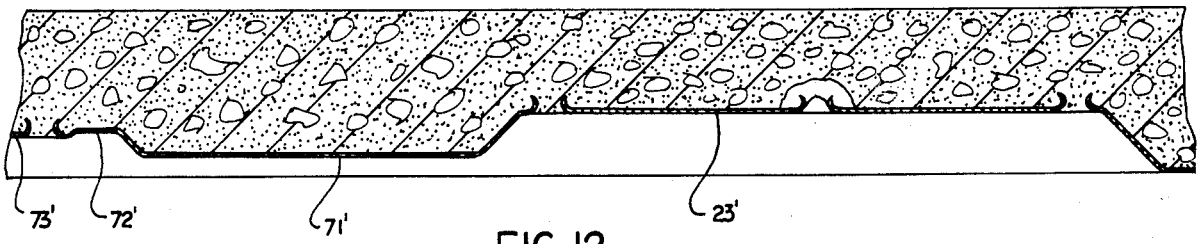
FIG. 12 is a fragmentary diagonal section taken along line 12—12 of FIG. 10.

FIGS. 10 through 12 illustrate a second embodiment which is similar in most respects to the first embodiment of FIGS. 1 through 8. Therefore, similar reference numerals will be used to refer to similar parts, but a prime will be added to indicate that reference is being made of the second embodiment.

In the embodiment of FIGS. 10 through 12, the bottom of the pan has been modified to provide the unfilled pan with greater stability. With this embodiment, the pan tends to remain flat or square even before the concrete is cast into the pan. However, in the first embodiment, there is a tendency for the pan to twist about diagonal lines, and it is therefore necessary to hold the pan flat while the concrete material is placed in the pan.

Such holding of the pan, of course, can be accomplished by the use of proper fixtures during the filling operation.

Here again, the pan is provided with a substantially planar border 21' extending in from side walls 16' to a central wall portion 22'. Four oval wall portions 23' are again provided along with four circular wall portions 24'. The bottom wall of the pan, however, is modified to provide four diagonal, shallow troughs 71', centrally located shallow rib ring 72', and a planar circular wall 73' encircled by the rib 72'. The four troughs 71' extend diagonally between the associated oval portion 23' and ring-shaped rib portion 72'. The ring-shped rib 72' in combination with the troughs 71' cooperate to provide the pan with stability prior to filling the pan with concrete. Therefore, the handling of the pan prior to filling with concrete and the fixturing of the pan during the filling process are simplified.

The variations in depth, however, created by the troughs 71' and the ribs 72' do not significantly change the depth of the concrete in the panel. For example, the bottom of the troughs 71' is only about 0.060 inch below the level of the adjacent central wall portions 22' and the planar circular wall 73' is only about ⅛ inch above the level of the central wall portion 22'. The ring-shaped rib 72' is disposed about 0.030 inch above the level of the circular wall 73. Except for the border 21' and the oval portions 23' and 24', the remainder of the castable material has a substantially uniform intermediate thickness.

Because the addition of the central portion 73', and the rib 72', and the troughs 71' does not materially change the overall thickness of the central portion of the panel, the overall weight of the panel is not significantly changed, nor is the deflection created by a load applied to the upper surface of the panel significantly changed.

In both embodiments, the thickness of the concrete material varies so that the thickness of the panel closely matches the stress applied to the panel when a concentrated load is applied at various locations along the load surface spaced from the corners. Consequently, substantially uniform deflections are produced under such loading conditions.

For example, if the panel were of uniform depth, a load applied to the mid-span centerline at the panel edges would produce a maximum amount of deflection. However, if such loads were moved in along such centerlines to locations corresponding to the circular wall portions 24, the deflections would be substantially less. If such load were again moved in to locations corresponding to the central portion 22, the deflection would again increase. Consequently, the removal of concrete depth in the zone above the circular portion 24 reduces the panel strength or stiffness in such zone to match the strain resulting from a load applied at such zone. Similarly, the reduced thickness along the central portion 22 weakens the panel in such portion so as to again match the stresses applied by the load. Tests performed on the embodiments illustrated establish that the deflections occurring when loads are applied substantially anywhere along the mid-span centerlines are essentially uniform.

A similar condition exists in the area of the oval-shaped wall portions 23. As a load is applied along diagonals of the panel, the stresses are low adjacent to the corner and the removal of concrete material in the zone of the oval wall portions 23 again tends to match the strength of the material with the stresses occurring when load is applied to such zones.

It should be recognized that if a load is applied at the corners, deflection is virtually nonexistent because the corners are supported by the pedestals. However, if a rolling load is applied along the diagonals, there will be a gradual increase in deflection as the load approaches the center of the panel and a gradual decrease in deflection as the load reaches its diagonally opposite corner. To this extent, panel deflections are not completely uniform. However, the panel deflections occurring in the panel when a load is applied at points spaced from the corners is very close to uniform and the tendency for rolling loads to jump or bounce as the load transverses the panel is eliminated.

It is preferable to form the pan contours so that the portions 22, 23, and 24 are substantially planar so that the shear ties will effectively interconnect the panel portions and the concrete. and will not tend to pull away from the concrete under deflection conditions.

Several advantages are achieved by contouring the pan so that the depth of concrete varies from one location to another. First, the amount of concrete required to fill the pan is minimized because concrete depths are reduced where panel strain is less. Further, the illustrated contouring results in a composite panel in which a given load applied substantially anywhere along the load surface 12 produces a uniform amount of panel deflection. For example, tests performed on the illustrated panel, in which a concentrated rated load was applied to the panel at substantially all of the various locations along the panel centerlines, produced a uniform amount of deflection of 0.030 inch. The deflection due to loads elsewhere on the load surface are somewhat less than 0.030 inch. This established that the illustrated contour very closely matched the strength and stiffness of the panel with the stresses and deflections which occur in the panel when a given concentrated load is applied in the most critical portions of the panel surface. Further, when a uniform deflection occurs, rolling loads move smoothly across the panel and do not tend to jump or skip along the panel surface. Further, the panel surface does not tend to ripple or otherwise become distorted due to repeated rolling loads.

It should be noted that the border wall portion 26 is laterally narrow as it extends from each corner, but that it gradually increases in width as it approaches the centerline of the panel. Because such border provides the maximum depth of concrete within the panel, and because it is widest at the center of each side, the panel is provided with increased strength and stiffness along the center of each side. Such maximum strength along the center of each side coincides with the location of highest stress applied to the panel by a given load. Consequently, deflections are maintained uniform. Similarly, the ramp 36 provides additional strength along the centerlines of the sides and, again, provides optimum matching of panel strength and stiffness to stresses induced in the panel when loads are applied in such area.

The panel in accordance with the present invention has additional advantage over an all-metal panel in that it is not necessary to provide a sound-deadening upper surface to avoid metallic-type noises when loads are applied to the panel. The concrete in itself is sound-deadening and dampens out any metallic-type noise even along the flanges 18 when loads are imposed thereon. Further, the panel is composed entirely of non-combustible materials and the panel can therefore be classified as an Underwriters Laboratories Class A product.

The contouring of the panels, in addition to providing an optimum load supporting system, also has the advantage of providing gripping ridges which facilitate the handling of the panels during installation and removal thereof.

Although the preferred embodiments of this invention have been shown and described, it should be understood that various modifications and rearrangements of the parts may be resorted to without departing from the scope of the invention as disclosed and claimed herein.

What is claimed is:

1. A rectangular access floor panel adapted to be supported at its corners and providing a substantially planar load-bearing surface to which loads are applied, comprising a sheet metal pan providing a contoured wall bounded by laterally extending side walls, said metal providing substantial tensile strength, and a non-metallic castable and settable material having a relatively high compressive strength filling said panel and providing said load surface which is the upper structural surface of said panel, said contoured wall providing:

(a) a substantially uniform, maximum thickness of castable material around the border of said panel;

(b) corner portions of said castable material adjacent to the corners of said panel each having a substantial area of substantially uniform minimum thickness;

(c) substantially the entire remaining portions of said castable material having an intermediate thickness, said panel providing substantially uniform deflections when a given concentrated load is applied substantially anywhere along said load surface spaced from the corners of said panel.

2. An access floor panel as set forth in claim 1, wherein said contoured bottom wall provides side portions inwardly spaced from substantially the centers of each side of said panel having a substantially uniform thickness of castable material having substantially said minimum thickness and an area less than the area of said corner portions.

3. A rectangular access floor panel as set forth in claim 2, wherein substantially the entire remaining portions of said panel have castable material of an intermediate thickness which varies only about $\frac{1}{8}$ inch in thickness.

4. An access floor panel as set forth in claim 3, wherein said contoured bottom wall provides a central portion of said castable material having a substantially uniform intermediate thickness about $\frac{3}{8}$ inch less than the thickness of said border.

5. An access floor panel as set forth in claim 1, wherein said castable material is a lightweight concrete material having good compressive strength and relatively low tensile strength.

6. An access floor panel as set forth in claim 5, wherein said concrete aggregates include a selected blend of expanded shale and vermiculite.

7. An access floor panel as set forth in claim 1, wherein said load surface is flush with said upper edges, and said pan provides inwardly extending flanges along and bordering said load surface which operates to protect the edges of said castable material to prevent chipping and erosion thereof when loads are applied to said edges of said castable material.

8. An access floor panel as set forth in claim 7, wherein said side walls provide a lateral rib adjacent to said flanges.

9. An access floor panel as set forth in claim 8, wherein said lateral rib extends along the sides of said panel to ends spaced from the corners of said panel, and said flanges are recessed below the plane of said load surface at said corners.

10. An access floor panel as set forth in claim 1, wherein said side portions and corner portions of reduced depth have a rounded shape.

11. An access floor panel as set forth in claim 10, wherein said corner portions of reduced depth are oval and are symmetrically positioned along diagonals of said panel.

12. A rectangular panel as set forth in claim 1, wherein an interconnection is provided between said concrete and said pan at least at relatively closely spaced intervals along the interface therebetween causing said pan and concrete to efficiently cooperate in supporting loads applied to said load surface.

13. An access floor panel as set forth in claim 1, wherein said pan includes projections sheared from the metal of said pan extending laterally from the adjacent surface thereof and embedded into said castable material to interconnect said pan and castable material.

* * * * *